US007520793B2

(12) United States Patent
Pillai et al.

(10) Patent No.: US 7,520,793 B2
(45) Date of Patent: Apr. 21, 2009

(54) MANIPULATIVE TOY HAVING INTERCHANGEABLE APPENDAGES

(76) Inventors: Gopala Pillai, 32885 Wintergreen Dr., Solon, OH (US) 44139; Mark Yager, 6178 Booth Rd., Ravenna, OH (US) 44266; Mike Grasela, 4620 McGregor Ave., Newburg Heights, OH (US) 44105; Jason Karecki, 12945 Cedar Rd., Cleveland Heights, OH (US) 44118

( * ) Notice: Subject to any disclaimer, the term of this patent is extended or adjusted under 35 U.S.C. 154(b) by 0 days.

(21) Appl. No.: 10/627,031

(22) Filed: Jul. 25, 2003

(65) Prior Publication Data

US 2005/0020179 A1 Jan. 27, 2005

(51) Int. Cl.
*A63H 17/00* (2006.01)

(52) U.S. Cl. ..... 446/97; 446/92; 446/99

(58) Field of Classification Search ..... 446/97, 446/98, 100, 101, 92, 129, 137, 139
See application file for complete search history.

(56) References Cited

U.S. PATENT DOCUMENTS

| | | | | | |
|---|---|---|---|---|---|
| 3,246,422 | A * | 4/1966 | Teagarden | 446/138 |
| 3,375,604 | A * | 4/1968 | Alonso | 446/92 |
| 3,464,146 | A * | 9/1969 | McCurdy | 446/100 |
| 3,660,926 | A * | 5/1972 | Lerner et al. | 446/73 |
| 4,186,515 | A * | 2/1980 | Ogawa | 446/99 |
| 4,208,832 | A * | 6/1980 | Corriveau | 446/100 |
| 4,869,701 | A * | 9/1989 | Kawai et al. | 446/91 |
| 5,380,233 | A * | 1/1995 | Numoto | 446/92 |
| 5,788,554 | A * | 8/1998 | Goodwin et al. | 446/100 |
| 5,897,420 | A * | 4/1999 | Lawrence et al. | 446/321 |
| 5,980,260 | A * | 11/1999 | Caputi | 434/295 |
| 6,887,120 | B2 * | 5/2005 | Shamitoff | 446/99 |
| 2003/0171062 | A1 * | 9/2003 | Ruiz Gonzalez | 446/92 |

* cited by examiner

*Primary Examiner*—Dana Ross
*Assistant Examiner*—Jamila Williams
(74) *Attorney, Agent, or Firm*—Grimes & Battersby LLP; James F. McLaughlin

(57) ABSTRACT

A manipulative toy is provided comprising a body and a plurality of interchangeable appendages, such as arms, legs, heads, tails and wings, removably attachable to the body at certain predefined coupling points using complementary magnetic elements disposed within both the appendages and the body. The appendages are retained in place by the interaction between two sets of complementary ribbed elements disposed on both the body and the appendages about the magnetic elements, which complementary ribbed elements are formed in a beveled configuration. The configuration of these ribbed elements, in combination with attractive force of the complementary magnetic elements and the frictional engagement of the complementary ribs, limits the appendages from moving rotationally about the point of attachment, and limits the movement of the appendage in the plane of the point of attachment, thereby allowing the manipulative toy to be posed by a user and retain its position.

17 Claims, 6 Drawing Sheets

DETAIL OF MAGNETIC ANIMALS LIMB JOINTS
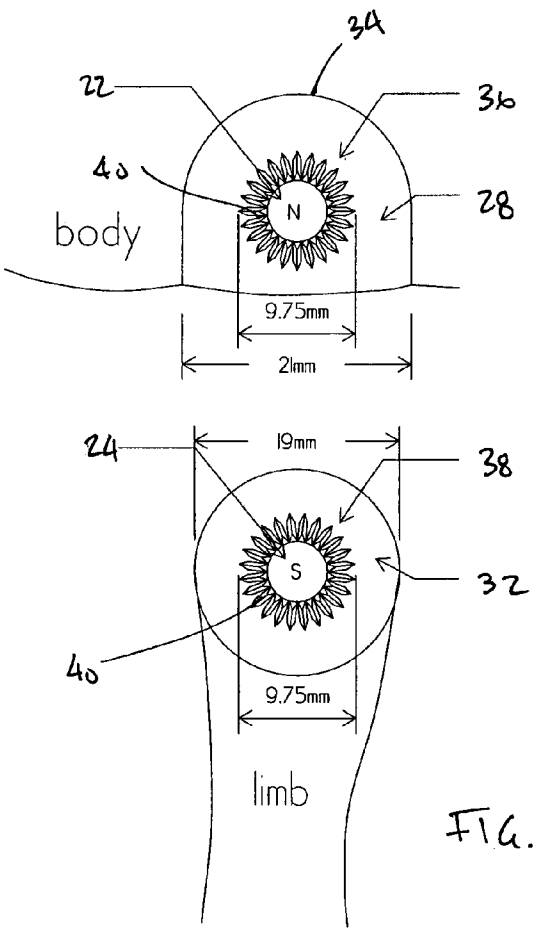
FIG. 3
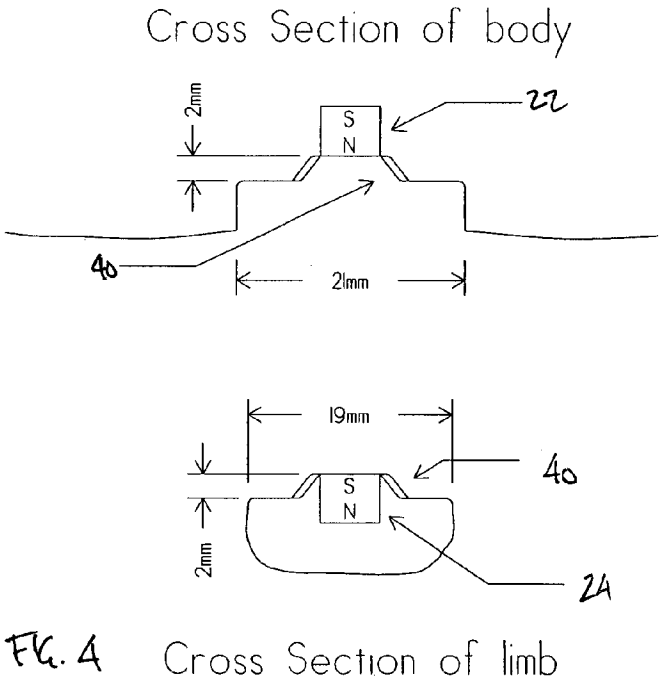
FIG. 4 Cross Section of limb

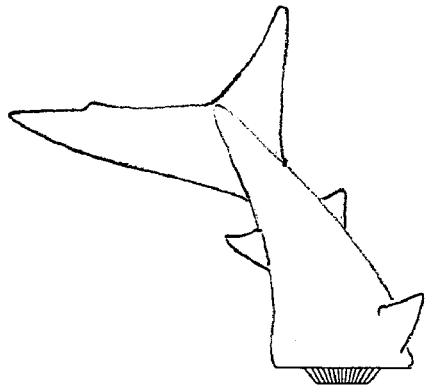
FIG. 6
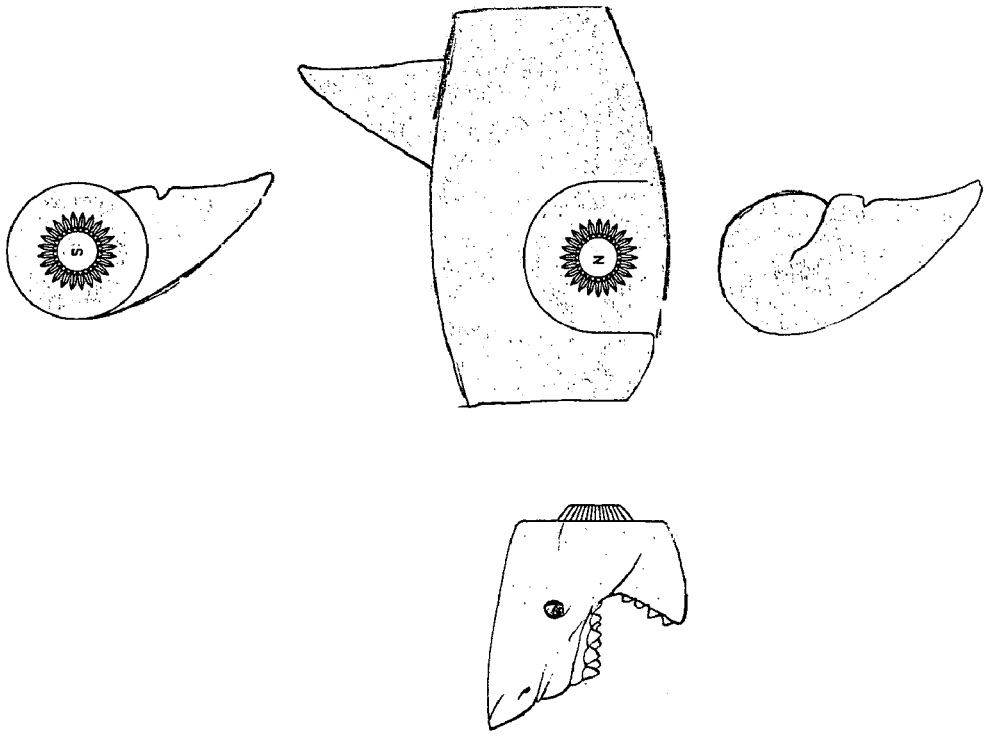

MANIPULATIVE TOY HAVING INTERCHANGEABLE APPENDAGES

BACKGROUND OF THE INVENTION

1. Field of the Invention

The present invention relates generally to a manipulative toy having interchangeable appendages, and, more particularly, to such a manipulative toy that includes a body and a plurality of interchangeable appendages, such as arms, legs and heads, said appendages being removably attachable to the body by means of magnetic elements in both said appendages and said body. Said appendages are retained in place by means of the interaction between two sets of complementary ribbed elements disposed on both the body and the appendage, which interaction prevents the appendages from moving or rotating, thereby allowing the manipulative toy to be posed by a user and retain its position.

2. Description of the Prior Art

The prior art fails to specifically address either the problem or the solution arrived upon by applicant. Manipulative toys have long been known in the toy industry, and the use of magnets as an attaching means has been used for a wide variety of products, including toys. For example, U.S. Pat. No. 5,746,638, which issued to Shiraishi on May 5, 1998 for a "Magnetic toy blocks" discloses a block toy composed of a plurality of blocks magnetically connectable to each other, with at least one of the blocks comprising a block main body having plural flat surface portions, magnet holding portions formed on inner sides of the respective flat surface portions, and permanent magnets accommodated within the respective magnet holding portions for rotation about imaginary axes extending at right angles relative to the flat surface portions corresponding to the magnet holding portions.

Furthermore, it has long been known to use magnetic attaching means in manipulative dolls. For example, U.S. Pat. No. 4,038,775, which issued to Sato on Aug. 2, 1977 for a "Doll body with magnet and pole pieces and detachable appendages" discloses a doll having a plurality of segments having joint or articulation means which are magnetically and removably coupled to each other. Similarly, U.S. Pat. No. 4,118,888, which issued to Ogawa on Oct. 10, 1978 for an "Articulated magnetic doll" discloses an articulated magnetic toy having removable appendages, including body shells encapsulating a magnet and pair of armature plates, wherein the appendages resemble humanoid arms and legs.

Such manipulative toys need not be limited to dolls, however. Among the myriad of possibilities of shapes and configureations for these toys are animals and other creatures. For example, U.S. Pat. No. 4,186,515, which issued to Ogawa on Feb. 5, 1980 for a "Toy horse vehicle," discloses a toy assembly capable of being configured into a simulated horse comprising a body member containing a pivotal connection attached to a joint assembly configured and positioned on the body member to represent respectively the withers and breast of the horse, with magnetically attachable appendage members of various configurations, including a horse's head and the upper torso of a humanoid robot, as well as various removable accessory parts.

Another example of a manipulative toy having an animal configuration is disclosed in U.S. Pat. No. 5,980,260, which issued to Caputi on Nov. 9, 1999 for a "Inter order/family prehistoric lizard display model," which teaches toy replicas of prehistoric lizards which consist of a replica core body part with interchangeably attachable head, neck, limb, or body armor parts which combine to depict different species within a given biological order or family, said parts being attached by means of ¾" circular magnets.

Yet another example of an animal-themed manipulative toy using magnetic means to attach the appendages is disclosed in U.S. Pat. No. 5,295,889, which issued to Ejima on Mar. 22, 1994 for a "Magnetically jointed toy for emitting stimuli." The toy comprises a body constituted by a trunk, and attachments including a head, arms and legs detachably combined with the trunk, which attachments are made by means of a plurality of magnets. A sound producing unit and a light emitting unit are provided in the toy so as to be actuated when the attachments each are combined with the toy body.

Similar devices are also disclosed in U.S. Pat. Nos. 3,883,984, 3,375,604, 2,465,971, and 2,457,249.

As will be appreciated, none of these prior patents even address the problem faced by applicant let alone offer the solution proposed herein.

SUMMARY OF THE INVENTION

Against the foregoing background, it is a primary object of the present invention to provide a manipulative toy having a body and a plurality of interchangeable appendages that are removably attached to the body utilizing a combination of magnetic means and complementary ribbed elements disposed on both the body and the appendages.

It is another object of the present invention to provide such a manipulative toy that is configured in the shape of an animal.

It is still another object of the present invention to provide such a manipulative toy that allows a user to utilize the appendages from a variety of different configurations of animals so as to create new species of animals representing a composite of arms, legs, heads, tails bodies and other appendages.

It is another object of the present invention to provide such a manipulative toy which encourages creativity of thinking and experimentation by the user.

It is another object of the present invention to provide such a manipulative toy in which the interaction between the complementary ribbed elements limits the appendages from moving rotationally relative to the point of attachment, and further limits the movement of said appendages in the plane of the point of attachment, thereby allowing a user to pose the toy and have the toy retain its position in said pose.

It is but another object of the present invention to provide such a manipulative toy that is inexpensive to manufacture.

It is yet still another object of the present invention to provide such a manipulative toy in which the body and the appendages are sturdy and may be roughly treated by a user yet still retain their shape and utility.

To the accomplishments of the foregoing objects and advantages, the present invention, in brief summary, comprises a manipulative toy that includes a body and a plurality of interchangeable appendages, such as arms, legs, heads, tails and wings, said appendages being removably attachable to the body at certain predefined coupling points by means of complementary magnetic elements disposed within both said appendages and said body. Said appendages are retained in place by means of the interaction between two sets of complementary ribbed elements disposed on both the body and the appendages about said magnetic elements, which complementary ribbed elements are formed in a beveled configuration. The configuration of these ribbed elements, in combination with attractive force of the complementary magnetic elements and the frictional engagement of the complementary ribs, limits the appendages from moving rotationally about the point of attachment, and limits the movement of the appendage in the plane of the point of attachment, thereby allowing the manipulative toy to be posed by a user and retain its position.

BRIEF DESCRIPTION OF THE DRAWINGS

The foregoing and still other objects and advantages of the present invention will be more apparent from the detailed explanation of the preferred embodiments of the invention in connection with the accompanying drawings, wherein:

FIG. 3 is a detailed view of the connection means between the body and the appendages of the manipulative toy of the present invention.

FIG. 4 is a cross-sectional view of the connection means between the body and the appendages of the manipulative toy of the present invention.

FIGS. 5 and 6 are exploded front elevational views of alternative embodiments of the manipulative toy of the present invention showing various possible appendages.

DETAILED DESCRIPTION OF THE INVENTION

Figure 1:
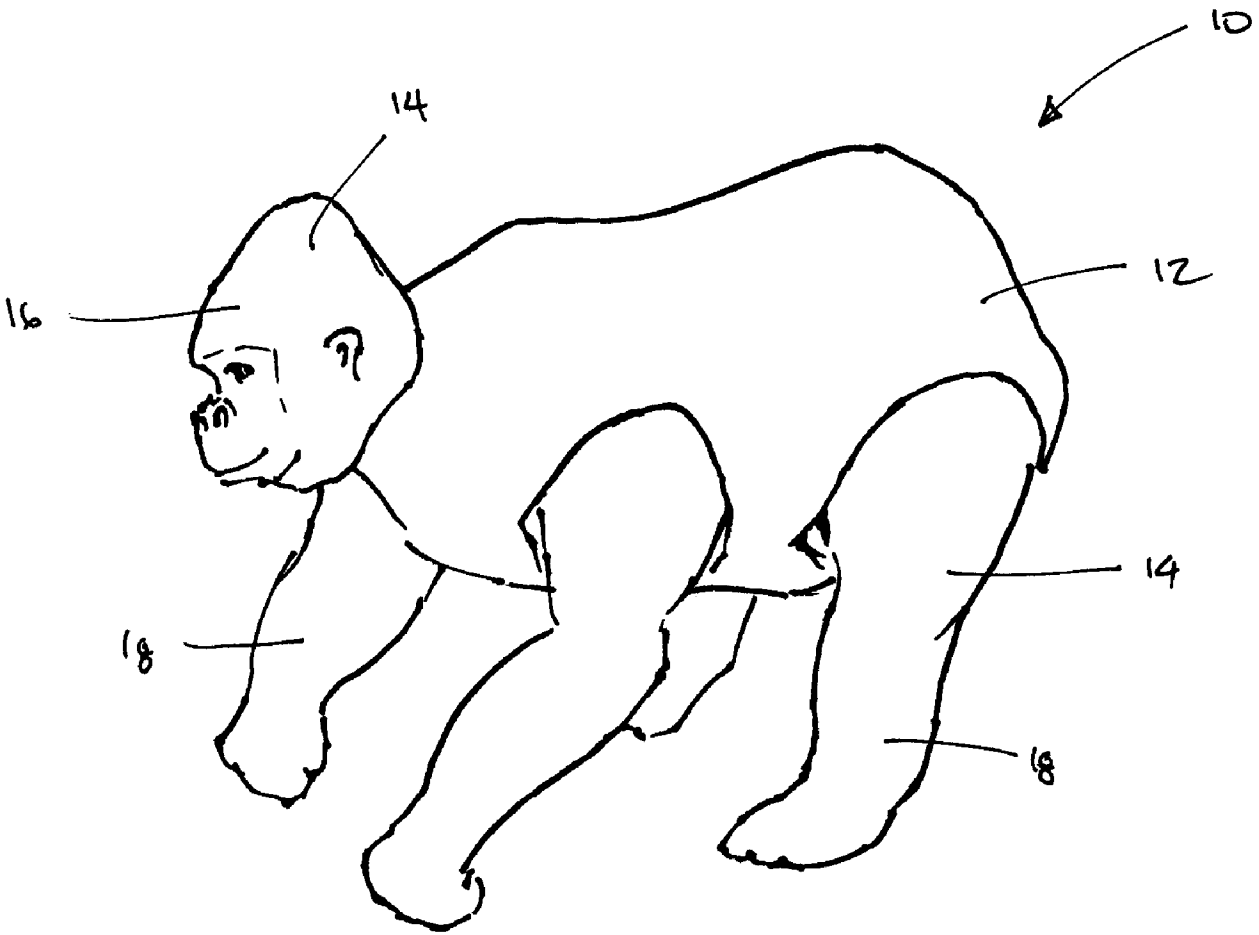
FIG. 1 is a perspective the manipulative toy of the present invention.
Figure 2:
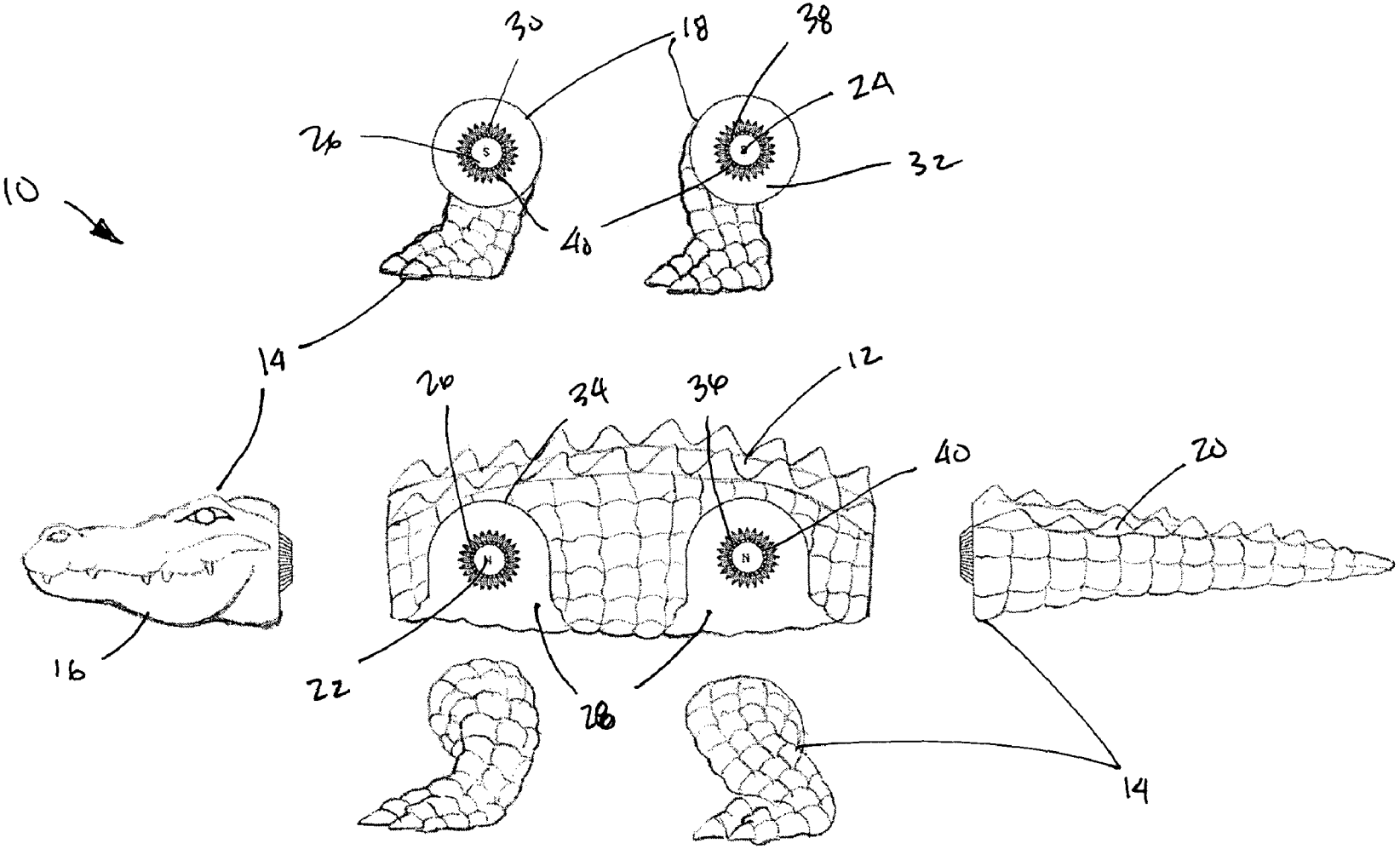
FIG. 2 is an exploded front elevational view of the manipulative toy of the present invention showing the body and the various appendages and the connection means therebetween.
Figure 5:
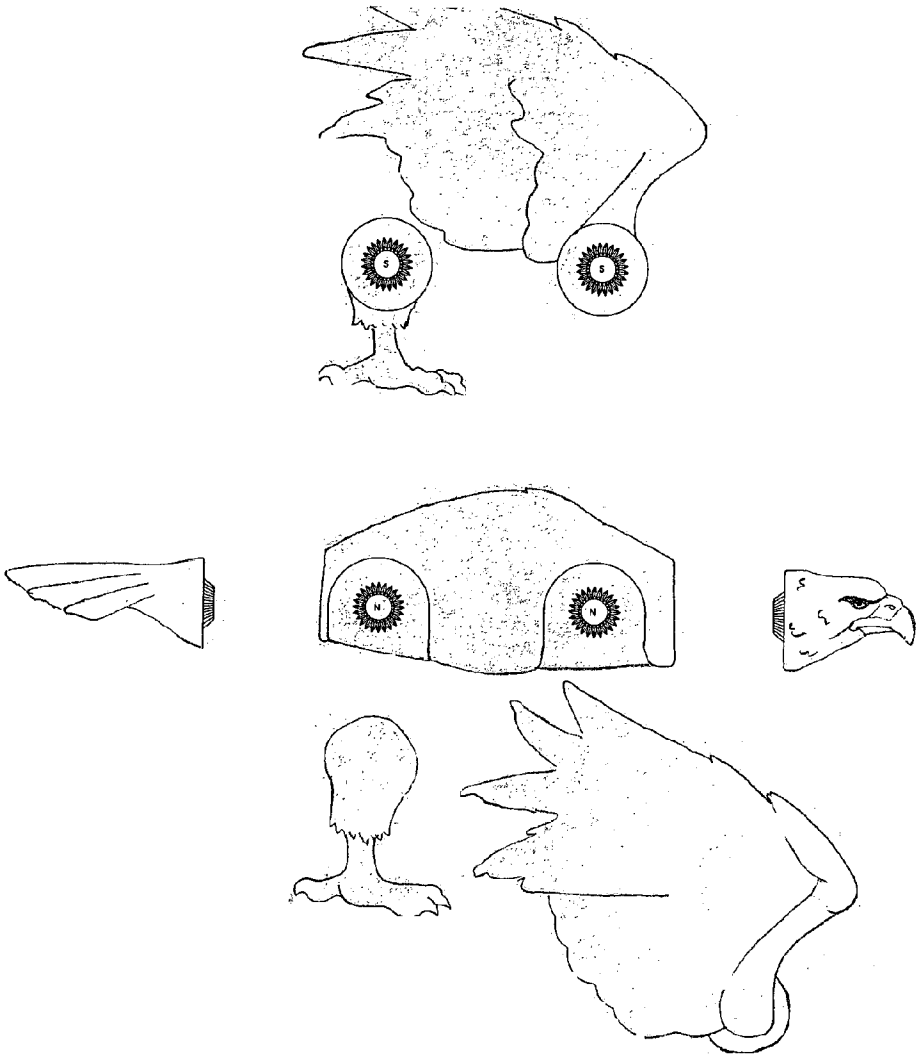

Referring to the drawings and, in particular, to FIGS. 1 and 2 thereof, the interactive manipulative toy of the present invention, referred to generally by reference numeral 10, is illustrated. The toy 10 comprises a main body 12 and a plurality of appendages 14, which appendages may take a variety of forms, depending upon the animal or creature the toy 10 is formed to simulate. In the embodiment shown in FIG. 1, where the toy 10 is in the configuration of an alligator, the appendages 14 include a head 16, legs 18 and tail 20. Other appendages include arms, wings, fins or even tentacles. Some alternative embodiments of the interactive manipulative toy of the present invention are shown in FIGS. 5 and 6. The appendages 14 are attached at the same area on the body 12 as they would be on the actual creature the toy 10 is designed to emulate, such as the neck or at the shoulder.

In the preferred embodiment, the components of the manipulative toy 10 are composed of a rigid, workable material such as plastic or resin, and are fabricated as solid elements. However, it should be appreciated that any number of various materials may be used, such as metal or wood, and the body 12 and appendages 14 may be either solid or hollow.

The appendages 14 are removably attachable to the body 12 of the manipulative toy 10 by means of complementary magnetic elements 22, 24 disposed within the body 12 and the appendages 14, respectively. The magnetic elements 22 are disposed in the body 12 so as to present the opposite magnetic pole that is presented by the magnetic elements 24 disposed in the appendages, such that the elements 22 will attract the elements 24. In the preferred embodiment, the magnetic elements 22, 24 are Nd—Fe—B magnets in a cylindrical configuration having a diameter of 5 mm and a height of 4 mm. However, it should be appreciated that any number of alternative magnets may be used provided, of course, they have the attractive strength to retain the appendage 14 against the body 12.

The appendages 14 are attached to the body 12 at a plurality of attachment points 26, which attachment points 26 correspond roughly to the locations that the appendages are connected to the body of the actual animal or creature upon which the toy 10 is based. For example, the attachment point 26 for the head 16 corresponds to the neck of the body 12, while the attachment point for the tail 20 corresponds to the opposite end of the body 12. These attachment points 26 are relatively standardized such that most of the appendages 14 may be attached to all of the attachment points 26, regardless of whether or not they actually belong there on the actual creature. For example, the head 16 may be attached to the attachment point 26 for the tail 20 and vice versa. More importantly, the appendages 14 from one creature, such as a kangaroo, may actually be attached to the attachment points 26 of the body of another creature, such as an ostrich, so as to allow the user to create a fanciful creature. In fact, the appendages from a number of creatures or animals may be combined so as to create a variety of fanciful creatures, such as an alligator with wings and the head of an ape. Such a feature allows the user to exercise his or her imagination and creativity in coming up with strange and exotic combinations.

In order to allow for as much realism in the ultimate configuration of the toy 10 as possible, the appendages 14 may be attached to the attachment points in a variety of positions or poses. For example, the head 16 may be turned to the side or the legs 18 may be positioned so as to appear as if the animal was caught mid-stride. Such positioning is accomplished by allowing the appendages 14 to be rotated about the point of attachment between the magnets 22, 24.

In order to achieve such desired effect, the attachment points 26 on the body 12 are planar, with the magnetic element 22 being situated at the center of a planar area 28, as shown in FIG. 3. The area of attachment 30 on the appendage is also a planar area 32 with the corresponding magnetic element 24 also being situated roughly at the center of this planar area 32. When the appendage 14 is attached to the body 12 by means of the attraction between the magnetic elements 22, 24, the planar areas 28, 32 are situated immediately adjacent to each other. It should be appreciated, therefore, that the shape of the planar areas 32, 34 should be relatively consistent so as to allow a variety of different appendages 14 to be attached to the various attachment points 26. In the preferred embodiment, the shape of the areas of attachment 30 is roughly circular, and the shape of the attachment points 26 is at least partially circular. Such configuration allows the appendages 14 to be rotated about the axis defined by the attachment of the magnetic elements 22, 24. In the preferred embodiment, the attachment points 26 are often recessed below the outer surface of the body 12 so as to present a more aesthetically pleasing and natural looking appearance when the appendages 14 are attached to the body 12. The recessed attachment points 26 are shown in FIGS. 1 and 2, with the upper portion being bounded by a fender-like ridge 34. In addition to its appearance as the socket joint of the shoulder, this ridge 34 serves to assist in the retention of the appendage 14 by preventing the appendage 14 from sliding up the side of the body 12. The ball joint portion of the shoulder, which corresponds to the area of attachment 30 on the appendage 14, fits within the recessed attachment point 26 and is surrounded by the ridge 34.

It should be appreciated that the magnetic elements 22, 24 alone are not sufficient to receive and retain the appendages 14 against the body 12, inasmuch as the appendage 14 would rotate freely about the axis formed by the magnetic elements 22, 24, thereby preventing the manipulative toy 10 from being posed. In order to limit the rotational movement, as well as much of the linear movement, of the appendages 14 corresponding ribbed elements 36 and 38 are provided on the attachment points 26 and area of attachment 30, respectively. The ribbed elements 36, 38 comprises a plurality of ribs 40 disposed in a circular configuration about the magnetic elements 22, 24. The ribbed elements 36, 38 are designed in corresponding configurations so as to be in frictional contact with each other when the appendage 14 is attached to the body 12 such that individual ribs 40 of each ribbed element 36, 38 engage each other so as to limit or prevent rotational movement relative to each other. By virtue of such interaction, the appendages 14 may be posed in a certain position and prevented or limited from rotating out of said position. Such feature is crucial for the legs 18 of the manipulative toy 10, which elements serve to support the weight of the entire toy when posed in the standing position. If the legs 18 were allowed to rotate about the magnetic elements 22, 24, the toy 10 would collapse on itself, since the force of attraction between the magnetic elements 22 alone does not prevent the legs 18 from rotating outwards or inwards. This would also be true for wings, which gravity would force to rotate from an upwardly extending position towards the ground.

In the preferred embodiment, the ribs 40 on both ribbed elements 36, 38 are 24 in number, are approximately 0.75 mm wide and 0.75 mm deep, and are configured in a circular pattern approximately 9.75 mm in diameter around the magnetic elements 22, 24. In such embodiment, the approximate diameter of the planar area 28 of the body 12 approximately 21 mm and that of the planar area 32 of the appendages 14 is approximately 19 mm. The difference in these diameters is necessary so as to provide clearance between the area of attachment 30 and attachment points 26. However, it should be appreciated that the ribs 40 and the configuration thereof, as well as the size and shape of the planar areas 28, 32, attachment points 26 and areas of attachment 30 may be altered so as to accommodate the particular size and weight of the body 12 and appendages 14.

In order to further strengthen the attachment between the appendages 14 and the body 12, the ribbed elements 36, 38 may be beveled or otherwise angled, as shown in FIG. 4. In the preferred embodiment, the ribbed elements 36 in the body 12 are beveled so as to be recessed within the body 12, whereas the ribbed elements 38 on the appendages 14 are beveled so as to be raised above the planar area 32. In this way, the ribbed element 38 functions as a male attachment point to the complementary female attachment point of the ribbed element 36. This configurations strengthens the attachment of the appendages 14 to the body 12, prevents linear movement of the appendage 14 relative to the body 12 in the plane of the planar areas 28, 32, facilitates the alignment of the magnetic elements 22, 24, and allows a user to pose the various appendages in various rotational alignments about the axis formed by the line connecting the magnetic elements 22, 24. It should be appreciated that the angle of the bevel for the ribbed elements 36, 38 must be complementary such that the ribs 40 on each element are in frictional contact and engage each other when the appendage 14 is attached to the body 12.

Figure 7:
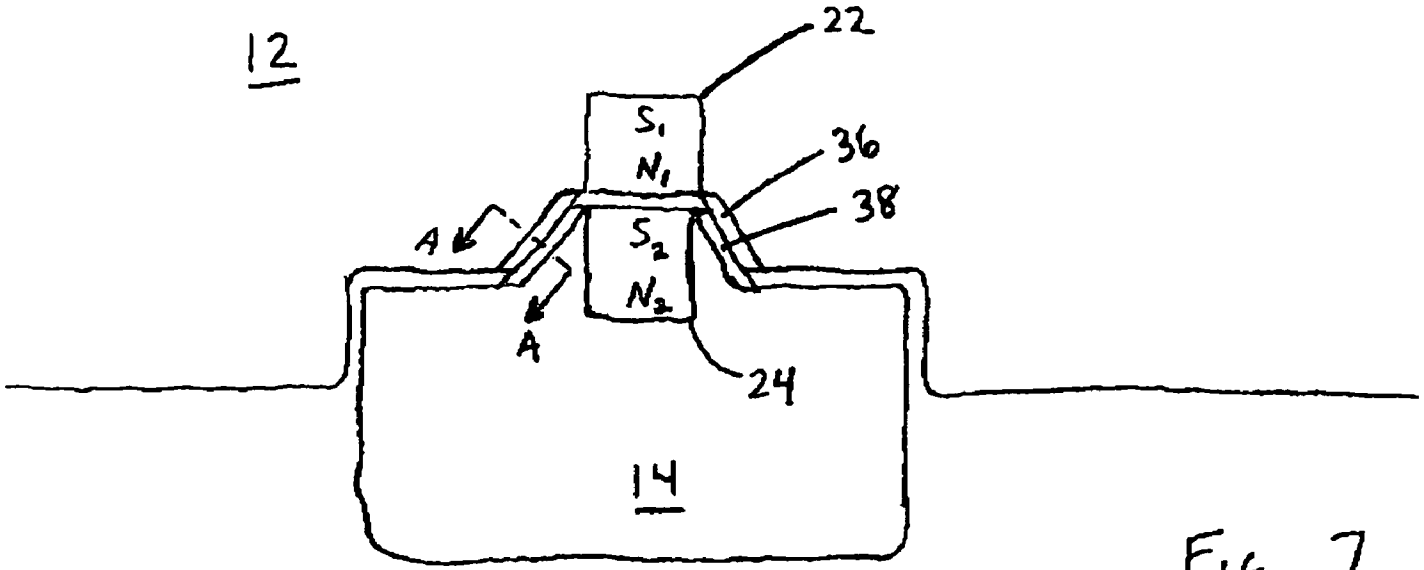
FIG. 7 is a cross-sectional view of the connection joint between the body and an appendage of the manipulative toy of the present invention.

Referring now to FIG. 7 the body 12 is shown in close proximity to an appendage 14. The body magnet 22 is in magnetic communication with the appendage magnet 24. It can be seen how each of the magnets 22, 24 is recessed into their respective anatomical part. The respective magnetic poles ($N_1$, $S_1$), ($N_2$, $S_2$) on each of the respective magnets 22, 24 has been further labeled in FIG. 7 to show how the magnets 22, 24 align so that their respective opposite poles $N_1$, $S_2$ are forcefully attracting each other and will facilitate, an firm coupling between the appendage 14 and the body 12.

Further in FIG. 7 it can be seen that the appendage ribs 36 are just beginning to engage the body ribs 38. As can been seen in FIG. 3, the ribs 36, 38 are radially disposed about the center of the respective attachment points 26, 28 of the respective body and appendage 14.

Figure 8:
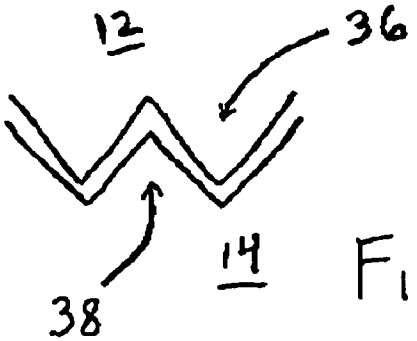
FIG. 8 is a cross-sectional view of a pair of engaged ribbed elements illustrating the mechanism of frictional engagement between the body and an appendage of the manipulative toy of the present invention.

Referring now to FIG. 8, a crosssection of FIG. 7 along line A-A is shown. A saw-tooth profile is displayed as the body ribs 36 engage the appendage ribs 38. The engagement of the ribs 36, 38 creates the rotational friction which stabilizes the appendage in any of a variety of angular positions as disclosed above.

Having thus described the invention with particular reference to the preferred forms thereof, it will be obvious that various changes and modifications can be made therein without departing from the spirit and scope of the present invention as defined by the appended claims.

We claim:

1. A manipulative toy configured in the shape of an animal having a head, tail, arms, legs or wings comprising:

a body configured in the shape of an animal, said body having a front, back and sides and further having a plurality of planar surfaces disposed on the sides thereof, said planar surfaces being recessed below the surface of said body and bounded on the upper portion thereof by an arcuate ridge, wherein the location of said planar surfaces on the sides of said body corresponds to the location of the arms, legs or wings of said animal, and further including a planar surface at the front of said body, said planar surface corresponding in location to the head of said animal, and further including a planar surface at the back of said body, said planar surface corresponding in location to the tail of said animal, wherein said planar surfaces disposed on the sides of said body, said planar surface at the front of said body and said planar surface at the back of said body are all practically identical in size and shape;

a circular depression centered in said body planar surface, said depression having a circular sidewall and a flat floor wherein said floor is parallel to said body planar surface;

a plurality of appendages each having at least one planar surface disposed at an end thereof, said planar surface on said appendages corresponding to said planar surfaces on said body, said appendages being configured in the shape of the head, tail, legs or wings of said animal;

a circular protrusion centered in said appendage planar surface, said protrusion having a circular sidewall and a flat roof wherein said roof is parallel to said appendage planar surface;

means disposed on both said body and said appendages for removably attaching said appendages to said body at said respective planar surfaces, wherein said ridge serves to conceal the attachment of said appendages to said body and to limit the motion of said appendages attached to said body, wherein said head, tail, legs or wings may be interchangeably attached to all of said planar surfaces; and means for limiting rotational and linear movement of said appendages relative to said body.

2. The manipulative toy of claim 1, wherein said means for removably attaching said appendages to said body comprises a pair of complementary magnetic elements, said complementary magnetic elements being disposed within said planar surfaces of said body and said appendages.

3. The interactive manipulative toy of claim 2, wherein said complementary magnetic elements are Nd—Fe—B magnets.

4. The interactive manipulative toy of claim 3, wherein said means for limiting movement comprises a pair of complementary ribbed elements disposed on each of said planar surfaces, wherein said ribbed elements frictionally engage each other when said appendages are attached to said body.

5. The manipulative toy of claim 4, wherein said ribbed elements comprise a plurality of raised ribs disposed in a circular configuration about said magnetic elements.

6. The manipulative toy of claim 5, wherein said ribs are approximately 0.75 millimeters wide and 0.75 millimeters deep, and are 24 in number.

7. The manipulative toy of claim 5, wherein the diameter of said circular configuration of said ribs is approximately 9.75 millimeters.

8. The manipulative toy of claim 7, wherein said planar surfaces are roughly circular in area.

9. The manipulative toy of claim 8, wherein the diameter of said planar surfaces on said body are approximately 21 millimeters, and the diameter of said planar surface on said appendages are approximately 19millimeters.

10. The manipulative toy of claim 9, wherein said ribs disposed on said appendages are beveled and raised above said planar surface on said appendages, and wherein said ribs disposed on said body are beveled and recessed below said planar surfaces on said body such that said beveled ribs are complementary to each other to thereby allow said ribs to frictionally engage each other when said appendages are attached to said body.

11. The manipulative toy of claim 1, wherein said ridge is configured so as to resemble a shoulder of said animal such that attachment of said appendages are lifelike in appearance.

12. The manipulative toy of claim 1, wherein at least one appendage and said body are composed of a rigid plastic material.

13. The manipulative toy of claim 1, wherein said body and said appendages are molded to simulate an animal.

14. A manipulative toy comprising:

a body configured in the shape of an animal, said body having a plurality of planar surfaces disposed on the sides thereof, said planar surfaces being recessed below an outer surface of said body and bounded on the upper portion thereof by an arcuate ridge, wherein the location of said planar surfaces on the sides of said body corresponds to the location of the arms, legs or wings of said animal, and further including a planar surface at the front of said body, said planar surface corresponding in location to the head of said animal, and further including a planar surface at the back of said body, said planar surface corresponding in location to the tail of said animal, wherein said planar surfaces disposed on the sides of said body, said planar surface at the front of said body and said planar surface at the back of said body are all practically identical in size and shape;

a plurality of appendages each having at least one roughly circular planar surface disposed at an end thereof, said planar surface on said appendages corresponding to said planar surfaces on said body, said appendages being configured in the shape of the head, tail, legs or wings of said animal;

a circular depression centered in said body planar surface, said depression having a circular sidewall and a flat floor wherein said floor is parallel to said body planar surface;

a circular protrusion centered in said appendage planar surface, said protrusion having a circular sidewall and a flat roof wherein said roof is parallel to said appendage planar surface;

means disposed on both said body and said appendages for removably attaching said appendages to said body at said respective planar surfaces, said means comprising a pair of complementary magnetic elements, said complementary magnetic elements being disposed within said planar surfaces of said body and said appendages, wherein said ridge serves to conceal the attachment of said appendages to said body and to limit the motion of said appendages attached to said body, wherein said head, tail, legs or wings may be interchangeably attached to all of said planar surfaces; and means for limiting rotational and linear movement of said appendages relative to said body, said means comprising a pair of complementary ribbed elements disposed on each of said planar surfaces, wherein said ribbed elements frictionally engage each other when said appendages are attached to said body, wherein said ribbed elements comprise a plurality of raised ribs disposed in a circular configuration about said magnetic elements.

15. The manipulative toy of claim 14, wherein said ribs disposed on said appendages are beveled and raised above said planar surface on said appendages, and wherein said ribs disposed on said body are beveled and recessed below said planar surfaces of said body such that said beveled ribs are complementary to each other to thereby allow said ribs to frictionally engage each other when said appendages are attached to said body.

16. The manipulative toy of claim 14, wherein said body includes an outer surface and wherein said planar surfaces on said body are recessed below the outer surface of said body, said recess being bounded on the upper portion thereof by a ridge.

17. A method for inspiring imagination and creativity using manipulative toys formed in the shape of various animals, said method comprising the steps of:

providing at least two manipulative toys configured in the shape of an animal having a head, tail, arms, legs or wings, each comprising:

a body configured in the shape of an animal, said body having a front, back and sides and further having a plurality of planar surfaces disposed on the sides thereof, said planar surfaces being recessed below an outer surface of said body and bounded on an upper portion thereof by an arcuate ridge, wherein the location of said planar surfaces on the sides of said body corresponds to the location of the arms, legs or wings of said animal, and further including a planar surface at the front of said body, said planar surface corresponding in location to the head of said animal, and further including a planar surface at the back of said body, said planar surface corresponding in location to the tail of said animal, wherein said planar surfaces disposed on the sides of said body, said planar surface at the front of said body and said planar surface at the back of said body are all practically identical in size and shape;

a plurality of appendages each having at least one planar surface disposed at an end thereof, said planar surface on said appendages corresponding to said planar surfaces on said body, said appendages being configured in the shape of the head, tail, legs or wings of said animal;

a circular depression centered in said body planar surface, said depression having a circular sidewall and a flat floor wherein said floor is parallel to said body planar surface;

a circular protrusion centered in said appendage planar surface, said protrusion having a circular sidewall and a flat roof wherein said roof is parallel to said appendage planar surface;

means disposed on both said body and said appendages for removably attaching said appendages to said body at said planar surfaces, wherein said ridge serves to conceal the attachment of said appendages to said body and to limit the motion of said appendages attached to said body, wherein said head, tail, legs or wings may be interchangeably attached to all of said planar surfaces; and means for limiting rotational and linear movement of said appendages relative to said body; and interchanging said appendages from said toys so as to create one or more fanciful creatures.

* * * * *